US007209134B2

(12) United States Patent
Chun et al.

(10) Patent No.: US 7,209,134 B2
(45) Date of Patent: Apr. 24, 2007

(54) LIQUID CRYSTAL DISPLAY

(75) Inventors: Se Eun Chun, Kyoungki-do (KR); Hwa Jeong Lee, Kyoungki-do (KR)

(73) Assignee: Boe Hydis Technology Co., Ltd., Kyoungki-do (KR)

( * ) Notice: Subject to any disclaimer, the term of this patent is extended or adjusted under 35 U.S.C. 154(b) by 372 days.

(21) Appl. No.: 10/669,995

(22) Filed: Sep. 24, 2003

(65) Prior Publication Data

US 2004/0189628 A1 Sep. 30, 2004

(30) Foreign Application Priority Data

Mar. 31, 2003 (KR) ..... 10-2003-0019949

(51) Int. Cl.
*G09G 5/00* (2006.01)
*G09G 3/36* (2006.01)

(52) U.S. Cl. ..... 345/213; 345/99

(58) Field of Classification Search ..... 345/87, 345/98–99, 204, 212, 213, 211; 348/521, 348/540, 542, 581, 582, 562, 513, 516, 500, 348/517
See application file for complete search history.

(56) References Cited

U.S. PATENT DOCUMENTS 6,025,817 A * 2/2000 Uno et al. ..... 345/38
6,313,813 B1 * 11/2001 Narui et al. ..... 345/3.2
6,690,368 B2 * 2/2004 Wu ..... 345/213
6,816,131 B2 * 11/2004 Narui et al. ..... 345/3.2
6,836,268 B1 * 12/2004 Song ..... 345/204

* cited by examiner

*Primary Examiner*—Amr A. Awad
*Assistant Examiner*—Stephen G Sherman
(74) *Attorney, Agent, or Firm*—Ladas & Parry LLP

(57) ABSTRACT

Disclosed is a liquid crystal display which can automatically select channels of signals outputted from a digital signal receiver according to frequencies of input signals, when the input signals are digital signals. According to the liquid crystal display, the liquid crystal display having a conversion board for basically receiving an outside power supply and a digital data signal including a dot signal, wherein the conversion board comprises; a digital signal receiver for receiving the outside power supply and the digital data signal including the dot signal; and a comparator for comparing whether a frequency of a dot signal is higher than a frequency used in a driving device for the liquid crystal display or not. In the liquid crystal display, without using a scaler having large cost and space in the conversion board, the manufacturing cost of the liquid crystal display can be reduced.

2 Claims, 3 Drawing Sheets

LIQUID CRYSTAL DISPLAY

BACKGROUND OF THE INVENTION

1. Field of the Invention

The present invention relates to a liquid crystal driving device having a channel selection function, and more particularly to a liquid crystal display in which channels of signals outputted from a digital signal receiver can be automatically selected according to frequencies of input signals, when the input signals are digital signals.

2. Description of the Prior Art

FIG. 1 is a block diagram showing a construction of a conventional liquid crystal display.

As shown in FIG. 1, the liquid crystal display includes a conversion board for receiving outside data and power supply, a LVDS section for converting the output of the conversion board into LVDS level and a LCD module for receiving the data and the power supply from the LVDS section through an input section. Herein, the conversion board includes a digital signal receiver (TMDS receiver) for receiving a digital signal, and a scaler for adjusting resolution. The LCD module includes a LCD panel, driving ICs, an inverter, a backlight, and a timing controller of outputting data signals, clock signals(dot signals) and various control signals for operating the driving ICs installed on the LCD panel.

In general, when an input data signal is a digital signal (DVI), a dot clock (signal) received together with the digital signal data is divided by 2 in the conversion board including the digital signal receiver (TMDS receiver) and the scaler, and then the 2-divided signals pass through two channels (even channel and odd channel: signal channels which are applied to even or odd drivers). Next, they are transmitted to the timing controller and the driving ICs through the LVDS section and the input section of the LCD module, and then data is finally displayed on the panel. Herein, a digital signal data applied to the LVDS section is equal to the digital signal data applied to the conversion board, and 2-divided signals applied to the LVDS section come out of the dot signal. However, in a case that the scaler is not included in the conversion board as shown in FIG. 2, in contrast with the above-described case in which the scaler is included in the conversion board as shown in FIG. 1, when the digital signal (DVI) is applied to the conversion board, full scaling can't be performed by only the digital signal receiver, but an image can be displayed on a central portion or a corner of the screen of the liquid crystal display.

However, in the case of a liquid crystal display without a scaler as shown in FIG. 2, when a dot signal carried with a digital signal as input signal is divided by 2 through two channels of the digital signal receiver, which are then applied to the timing controller and the driving ICs through the low voltage differential signal serial interface (LVDS section), the frequency of the two divided signals with a particular resolution may be sometimes lower than a minimum frequency for operating the timing controller or the driving ICs, thereby causing the display to be impossible.

SUMMARY OF THE INVENTION

Accordingly, the present invention has been made to solve the above-mentioned problems occurring in the prior art, and an object of the present invention is to provide a liquid crystal display, in which a digital signal receiver can selectively use channels without a scaler for adjusting resolution when an input signal is a digital signal, so that frequencies of dot signals to be divided by 2 through two channels can be elevated higher than a minimum frequency for operating a timing controller or driving ICs by means of only one channel when the frequencies of the dot signals are lower than the minimum frequency, and two channels can be selectively used as in the conventional method when frequencies of the dot signals to be divided by 2 are higher than the minimum frequency, thereby enabling the LCD to selectively use channels according to input signals and to thus stably display images even without the scaler.

In order to achieve the above objects, according to one aspect of the present invention, there is provided a liquid crystal display having a conversion board for basically receiving an outside power supply and a digital data signal including a dot signal, wherein the conversion board comprises; a digital signal receiver for receiving the outside power supply and the digital data signal including the dot signal; and a comparator for comparing whether or not a frequency of the dot signal is higher than a frequency used in a driving device for the liquid crystal display and determining whether or not the dot signal is divided by 2 according to the result of the comparison.

According to one aspect of the present invention, when the frequency of the dot signal is higher than a minimum frequency capable of operating a timing controller or driving a device, the frequency of the dot signal is divided by 2, the 2-divided signals are outputted through two channels and the digital signal is applied to a module of the liquid crystal display by means of the two channels, and when the frequency of the dot signal is lower than the minimum frequency capable of operating a timing controller or a driving device, the dot signal is outputted through one channel and the digital signal is applied to the module of the liquid crystal display by means of one channel.

According to one aspect of the present invention, in order to determine the frequency of the dot signal, either a vertical frequency signal or a horizontal frequency signal included in the digital data signal is applied to the comparator.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described with reference to the accompanying drawings.

Figure 1:
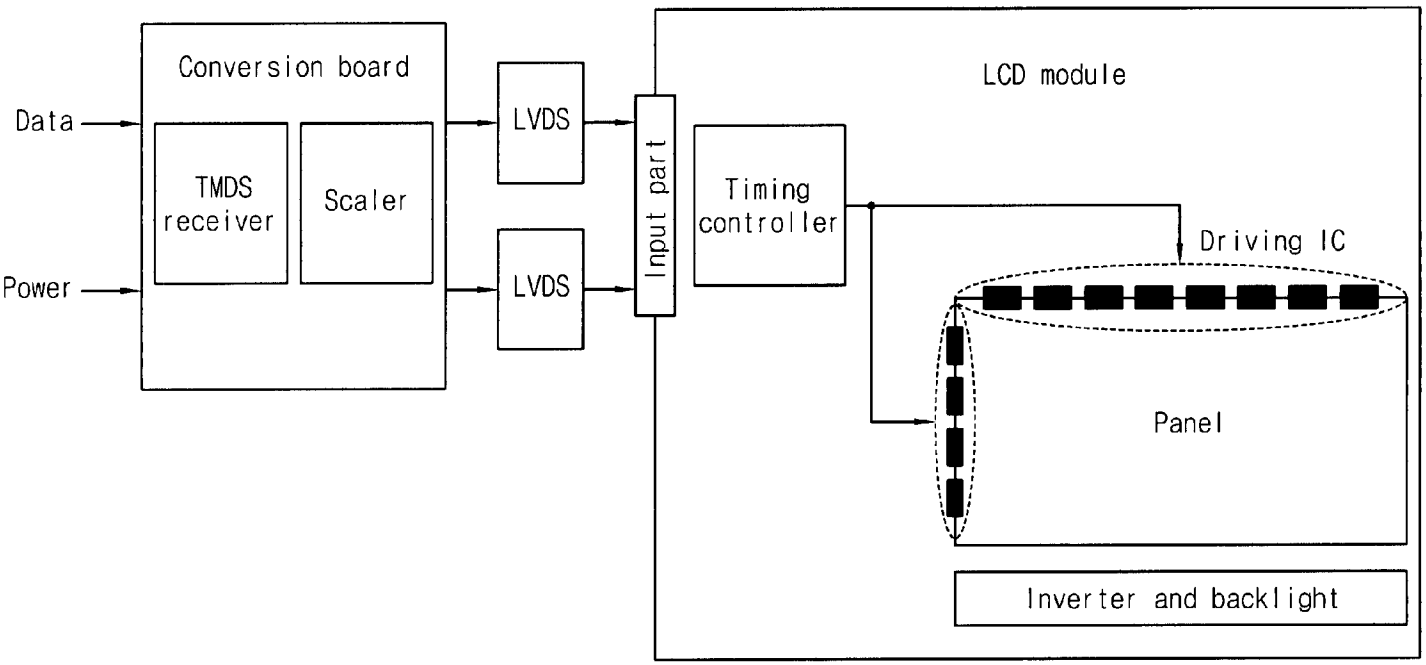
FIG. 1 (PRIOR ART)
FIG. 1 is a block diagram showing a construction of a conventional liquid crystal display having a conversion board including a scaler.
Figure 2:
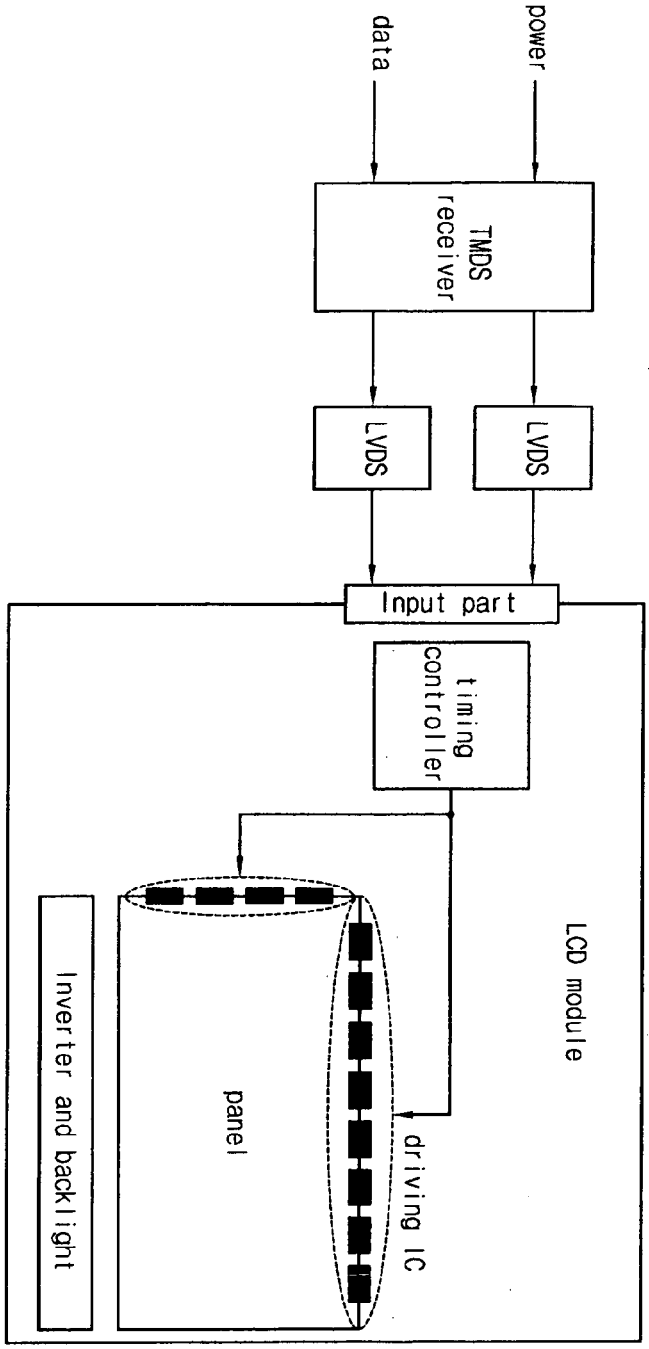
FIG.2 (PRIOR ART)
FIG. 2 is a block diagram showing a construction of a conventional liquid crystal display having a conversion board without a scaler.
Figure 3:
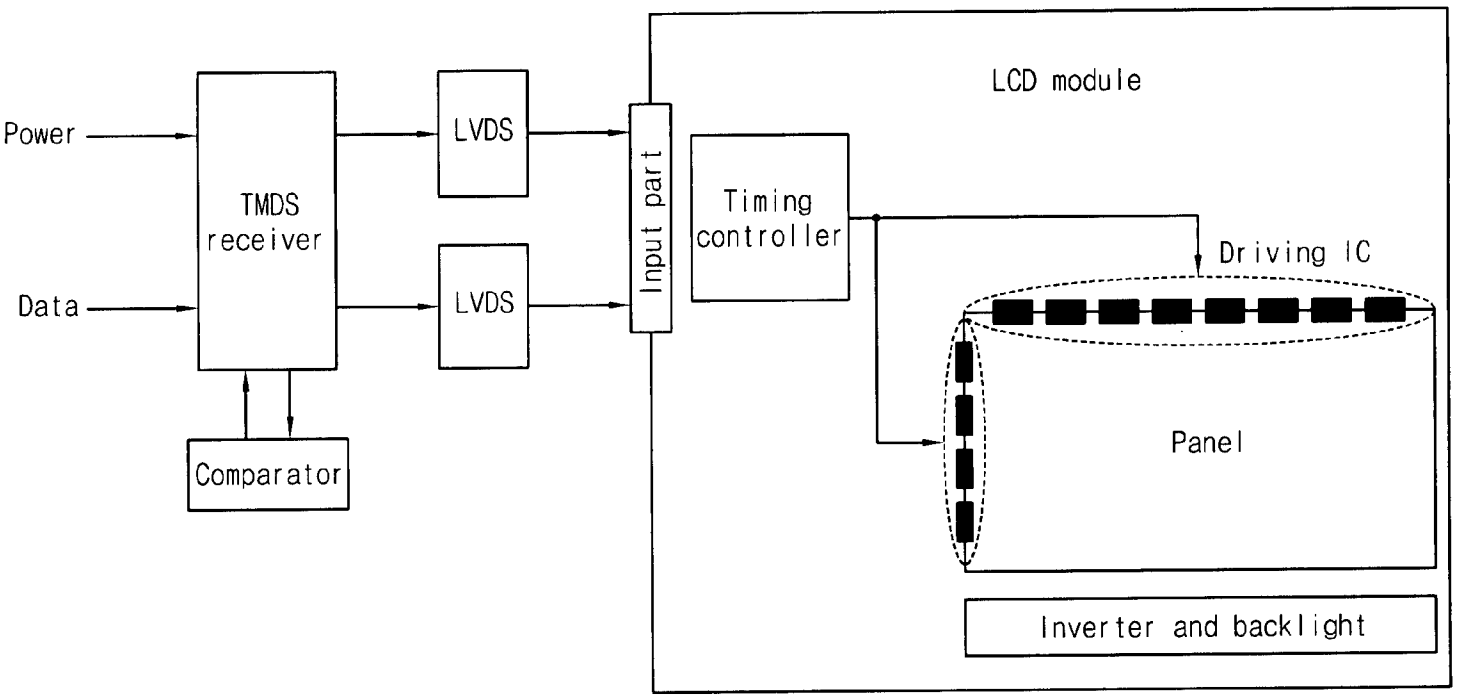
FIG. 3 is a block diagram showing a construction of a conventional liquid crystal display having a conversion board including a comparator.

FIG. 3 is an embodiment of a liquid crystal display including a conversion board according to the present invention.

As shown in FIG. 3, the conversion board of the liquid crystal display according to the present invention includes a comparator for comparing whether a frequency of a dot signal is higher than a frequency used in a driving device for the liquid crystal display or not and a digital signal receiver (TMDS receiver) for receiving a digital signal.

In an operation mode of the conversion board, when a digital data signal is applied to the digital signal receiver, a horizontal frequency signal (Hsync), which is included in an output signals of the digital signal receiver and carries frequency information of a dot signal, is applied to the comparator (for reference, a vertical frequency signal (Vsync) which carries frequency information of the dot signal may be used). After receiving the horizontal frequency signal, the comparator calculates a frequency to be divided by 2 through two channels of the digital signal receiver and then compares whether the calculated frequency value is higher than a minimum frequency capable of operating a timing controller or driving ICs or not.

As a result of the comparison, when the frequency to be divided by 2 through two channels is higher than a minimum frequency capable of operating two low voltage differential signal serial interfaces (LVDS), the comparator transmits a signal such as a high level signal to the digital signal receiver. Receiving the high level signal, the digital signal receiver is then set to divide the dot signal included in the input digital signal by 2 and to transmit the 2-divided signals through two channels (as even or odd channels) to the two low voltage differential signal serial interfaces (LVDS) respectively. The 2-divided signals having passed through the two low voltage differential signal serial interfaces (LVDS) are transmitted to the timing controller and the driving ICs. Therefore, normal display operation is performed.

Meanwhile, when the frequency to be divided by 2 through two channels is lower than the minimum frequency capable of operating the two low voltage differential signal serial interfaces (LVDS), the comparator transmits a low level signal to the digital signal receiver. Receiving the low level signal, the digital signal receiver is set to transmit the dot signal to one of the low voltage differential signal serial interfaces (LVDS) through one channel as the dot signal is. In this case, the dot signal included in the input digital signal is not divided and the digital signal is transmitted to only one of the two low voltage differential signal serial interfaces (LVDS). Since the dot frequency, which has not been divided, is lower than the minimum frequency for operating the timing controller and the driving ICs, the timing controller and the driving ICs normally operates.

As described above, in the liquid crystal display according to the above-mentioned embodiment of the present invention, without using a scaler having large cost and space in the conversion board, the manufacturing cost of the liquid crystal display can be reduced.

The preferred embodiment of the present invention has been described for illustrative purposes, and those skilled in the art will appreciate that various modifications, additions and substitutions are possible, without departing from the scope and spirit of the invention as disclosed in the accompanying claims.

What is claimed is:

1. A liquid crystal display having a conversion board for receiving an outside power supply and a digital data signal including a dot signal, wherein the conversion board comprises:

a digital signal receiver for receiving the outside power supply and the digital data signal including the dot signal; and a comparator for comparing whether a frequency of a dot signal is higher than a frequency used in a driving device for the liquid crystal display or not, wherein, when the frequency of the dot signal is higher than a minimum frequency capable of operating a timing controller or a driving device, the frequency of the dot signal is divided by 2, the 2-divided signals are outputted through two channels and the digital signal is applied to a module of the liquid crystal display by means of the two channels, and when the frequency of the dot signal is lower than the minimum frequency capable of operating a timing controller or a driving device, the dot signal is outputted through one channel and the digital signal is applied to the module of the liquid crystal display by means of one channel.

2. The liquid crystal display according to claim 1 wherein, in order to determine the frequency of the dot signal, either a vertical frequency signal or a horizontal frequency signal included in the digital data signal is applied to the comparator.

* * * * *